United States Patent [19]

Boaz

[11] 4,450,346

[45] May 22, 1984

[54] ELECTRIC HEATER PLATE

[75] Inventor: Premakaran T. Boaz, Livonia, Mich.

[73] Assignee: Ford Motor Company, Dearborn, Mich.

[21] Appl. No.: 263,637

[22] Filed: May 14, 1981

[51] Int. Cl.[3] ..... H05B 3/06

[52] U.S. Cl. ..... 219/522; 219/203; 219/541; 219/543; 338/309; 338/322

[58] Field of Search ..... 219/203, 522, 541, 543, 219/547; 338/309, 322

[56] References Cited

U.S. PATENT DOCUMENTS

| | | | |
|---|---|---|---|
| 3,532,858 | 10/1970 | Peetz | 219/522 |
| 3,634,654 | 1/1972 | Peetz | 219/522 |
| 3,813,519 | 5/1974 | Jochim et al. | 219/522 |
| 3,895,218 | 7/1975 | Cooks | 219/543 |
| 4,023,008 | 5/1977 | Durussel | 219/522 |
| 4,137,447 | 1/1979 | Boaz | 219/522 |
| 4,213,028 | 7/1980 | Wolf | 219/203 |
| 4,246,467 | 1/1981 | Boaz | 219/522 |

*Primary Examiner*—Volodymyr Y. Mayewsky
*Attorney, Agent, or Firm*—William E. Johnson; Olin B. Johnson

[57] ABSTRACT

An electric heater plate is disclosed which is formed on one surface of a base material. A plurality of thin lines of a nonprecious material which acts as a resistor when electrical energy flows therethrough is bonded to the first surface of the base material and extends from a first location thereon to a second location thereon. At least two interconnection areas of a non-precious metal which acts as a resistor when electrical energy flows therethrough are provided. These interconnection areas are bonded to the first surface of the base material with one interconnection area interconnecting the plurality of thin lines at the first location and the second of the interconnection areas interconnecting the plurality of thin lines at the second location on the first surface of the base material. A termination area of silver ceramic material is associated with each of the interconnection areas. Each of the terminal areas is in contact with an associated interconnection area. An electrical lead is bonded to each of the terminal areas for making electrical connection to the plurality of thin lines. If the electric heater plate is installed as the rear window of a motor vehicle, the heat generated by flowing the current through the thin lines can defog and deice the window.

6 Claims, 4 Drawing Figures

ELECTRIC HEATER PLATE

BACKGROUND OF THE INVENTION AND PRIOR ART STATEMENT

No prior art patent search was conducted on the subject matter of this specification in the U.S. Patent Office or any other search facility.

I am aware of my own U.S. Pat. No. 4,137,447, as being probably the most relevant prior art. My prior patent teaches an electric heater plate in which there is a substantial reduction in the amount of silver ceramic material used to form the heater plate.

My prior patent teaches an electric heater plate which is formed on one surface of a sheet of tempered glass. The one surface of tempered glass has a plurality of thin lines of a silver ceramic material bonded thereto, the thin lines extending in a generally parallel but spaced apart relationship across the sheet of glass. Left hand and right hand end portions of the plurality of thin lines are interconnected by a thin interconnection area of a silver ceramic material. A small terminal area of silver ceramic material is also associated with each of the interconnection areas located at opposite ends of the plurality of thin lines. A termination area is also bonded to the one surface of the sheet of tempered glass at a position spaced from the left hand and right hand interconnection areas. A thin copper strip is bonded to each of the terminal areas and the termination area associated with the left hand or right hand interconnection area to electrically interconnect the same. Electrical leads are connected to each of the pair of termination areas to provide a connection to a power system. When the power system is actuated, current flows through the plurality of thin lines in order to heat the tempered glass sheet. If the tempered glass sheet in installed as a rear window of a motor vehicle, the heat generated by flowing the current through the thin lines can defog and deice the window.

The structure proposed in this specification is one which once again substantially reduces the amount of silver ceramic material used in an electric heater plate construction. The structure proposed in this specification is also one which retains terminal areas formed of silver ceramic material so that secure bonds of electrical leads may be made thereto. The reduction in the amount of silver ceramic material used in forming the heater plate results in a significant cost savings.

The heater plates formed in accordance with the teachings of this specification have particular utility if they are formed on a sheet of glass which acts as the rear window of a motor vehicle. Electrical energy may be flowed through the heater plate construction in order to heat the same to cause a deicing and defogging action on any moisture which may have condensed upon or frozen upon the rear window.

SUMMARY OF THE INVENTION

This invention relates to an electric heater plate and more particularly to an electric heater plate in which both nonprecious metal and silver ceramic material are used to form the conductive pattern of the heater plate. The conductive pattern has a resistance which causes a heating of the pattern and associated heater plate when current flows through the pattern.

In accordance with the general teachings of this invention, an electric heater plate is formed in the following manner. A base material is selected for the heater plate. This base material has a first surface to which metallic materials may be bonded.

A plurality of thin lines of a nonprecious metal which acts as a resistor when electrical energy flows therethrough is bonded to the first surface of the base material. The plurality of thin lines extend from a first location on the first surface to a second location on that first surface of the base material. At least two interconnection areas of a nonprecious metal which acts as a resistor when electrical energy flows therethrough are bonded to the first surface of the base material. One of the interconnection areas interconnects the plurality of thin lines at the first location on the first surface. A second of the interconnection areas interconnects the plurality of thin lines at the second location on the first surface.

In accordance with the teachings of the structure of this invention, a terminal area of silver ceramic material is associated with each of the interconnection areas. Each of these terminal areas is in contact with an associated one of the interconnection areas. An electrical lead is bonded to each of the terminal areas for making electrical contact to the pluality of thin lines.

In accordance with one preferred embodiment of the structure of this invention, each terminal area has both a first portion thereof in contact with an associated interconnection area formed of the nonprecious metal and a second portion thereof bonded to the first surface of the base material. The second portion of each terminal area is not in contact with the associated interconnection area. The electrical lead is bonded to the second portion of each terminal area for providing the electrical connection to the plurality of thin lines.

In still greater detail, alternate embodiments of the electric heater of this invention provide that the first portion of the terminal area may either overlie or underlie the portion of the interconnection area with which it is associated.

Still further detailed embodiments of the structure of this invention require that the base material be a glass sheet. Other embodiments are ones in which the nonprecious metal is selected from the group consisting of copper, nickel and aluminum. As an additional detail, the electrical lead can be bonded to the terminal area by a solder bond.

BRIEF DESCRIPTION OF THE DRAWINGS

The novel features that are considered characteristic of the invention are set forth with particularlity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several figures, and in which:

DESCRIPTION OF THE PREFERRED EMBODIMENT

Figure 1:
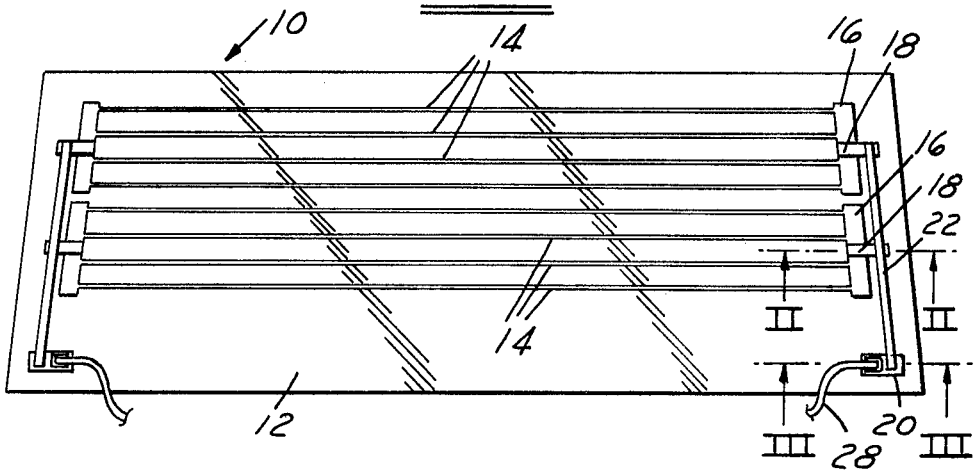
FIG. 1 is an elevation view of an electric heater plate constructed in accordance with the teachings of this invention.
Figure 2:
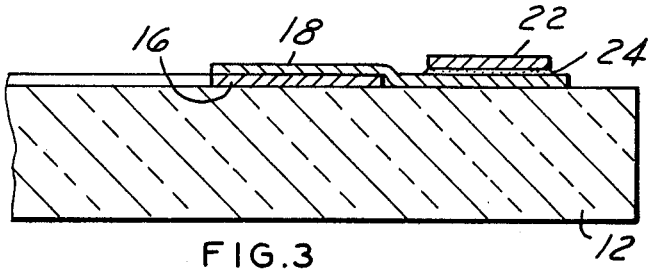
FIG. 2 is an enlarged drawing of a cross-section taken along line II—II of FIG. 1.

In FIG. 1 there is seen an electric heater plate generally identified by the numeral 10 which is constructed in accordance with the teachings of a preferred embodiment of this invention. The preferred embodiment is not intended to be a limitation upon the scope of this invention, but merely is a descriptive example of the application of this invention to the manufacture of a product for consumption in the industrial market.

As seen in FIG. 1, the electric heater plate 10 includes a sheet of glass 12 which, in accordance with general principles, is normally a glass sheet which will be tempered in a manner described hereinbelow. In accordance with the teachings of this preferred embodiment, the sheet of glass 12 is used as a backlite for an automotive vehicle.

As shown in FIG. 1, the sheet of glass 12 has a plurality of thin lines 14—14 of a nonprecious metal which acts as a resistor bonded to one surface thereof. In general, the one surface of the sheet of glass is that surface which faces the interior of the vehicle when the sheet of glass is located in an installed position. The plurality of thin lines 14—14 extend in a generally parallel but spaced apart relationship across a dimension of the sheet of glass. In the preferred embodiment, the parallel lines extend across the length of the glass sheet. As shown in FIG. 1, there are two groups of four parallel lines.

In accordance with the teachings of this invention, each of the group of plurality of thin lines 14—14 have right hand end portions 16—16 and similarly constructed left hand portions, not numbered, at opposite ends thereof. The right hand end portions and left hand end portions define interconnection areas. These interconnection areas are formed from a nonprecious metal which acts as a resistor when electrical energy flows therethrough. Each of the interconnection areas is bonded to the first surface of the sheet of glass 12. As mentioned above, one pair of the interconnection areas in the preferred embodiment interconnects the two groups of thin lines 14—14 at a first location on the first surface at the right hand edge of the sheet of glass, and a second pair of interconnection areas interconnect the two groups of thin lines at a second location on the first surface located at the left hand side of the sheet of glass.

The plurality of thin lines 14—14 and interconnection areas therefor such as the right hand end portions 16—16 are formed as mentioned above from a nonprecious metal which acts as a resistor when electrical energy flows therethrough. For example, a nonprecious metal which will work in this area is aluminum. This type of material is produced and sold by Englehard Company under the trade name E-373A Aluminum Paste. This nonprecious metal is applied in a conventional manner through a silk screen printing operation to form in a single operation both the thin lines 14—14 and their associated interconnection areas. The nonprecious metal in the form of a paste is applied through a suitable silk screen. As it passes through this screen, it adheres to the first surface of the sheet of glass 12. The nonprecious metal paste are finely divided particles of aluminum milled in low melting glass frits and other organic additives to facilitate silk screening of the paste. The additives burn out during the firing of the device.

After the silk screen printing of the thin lines 14—14 and associated interconnection areas such as the right hand end portion 16—16, a second silk screen operation takes place in order to apply a terminal area 18 in association with each of the interconnection areas such as the right hand end portions 16—16. These terminal areas 18—18 are formed from a silver ceramic material. The silver ceramic material is applied in a conventional manner through a silk screen printing operation. A low resistance, conductive silver paste is applied through a suitable silk screen. As it passes through this screen, it adheres to the sheet of glass 12 or underlying areas of an associated one of the interconnection areas such as the right hand end portions 16—16. In accordance with the teachings of the preferred embodiment, the silver ceramic silk screening operation is the second silk screening option. However, the silk screening operations may be reversed, as will be discussed in greater detail hereinbelow.

Typical of low resistance, conductive silver paste that may be used are Drakefield Silver Paste, A653, or Englehard Hanovia Silver Paste, 9124, both commercially available. The conductive silver paste contains finely divided particles of silver milled in squeegy oil and other organic additives and ceramic materials to facilitate silk screening of the paste. The additives burn out during the firing of the device.

After the two silk screening operations have been carried out, the sheet of glass 12 and the silk screened areas of both the nonprecious metal and the silver ceramic material applied thereto are heated to a temperature in the range of about 600° C. to 625° C. from four to five minutes in a tempering furnace. This temperature is above the strain point of the glass. During the heating of the glass, the nonprecious metal particles and silver ceramic particles bond to the glass by a bond which is believed to be in part chemical and in part mechanical. The glass sheet is subsequently cooled at a rapid rate to room temperature in order to temper the same and produce a tempered sheet of glass having both the nonprecious metal and the silver ceramic material bonded thereto.

In accordance with the teachings of a preferred embodiment of this invention, a power termination area 20 of a silver ceramic material may be formed at both the right hand side of the glass sheet as shown in FIG. 1 and at the left hand side of the glass sheet, not numbered, at the same time as the terminal areas are formed. The power termination area is used if one desires to make a two-lead connection from the thin lines 14—14 to the power supplying electrical system of the vehicle. This type of termination area will be discussed in greater detail hereinbelow.

Each of the terminal areas 18—18 on the right hand side of the sheet of glass 12 are interconnected by an electrical lead 22. This electrical lead can be in the form of a braided copper strip having a coating of solder thereover. This is in accordance with the teachings of the preferred embodiment of this invention as set forth herein. The electrical lead 22 is connected to the terminal areas 18—18 by applying heat to the electrical lead in a location in association with the terminal areas 18—18 in order to develop a solder bond 24 therebetween. This manner of connecting an electrical lead to terminal areas of silver ceramic material is well known in the art.

Figure 3:
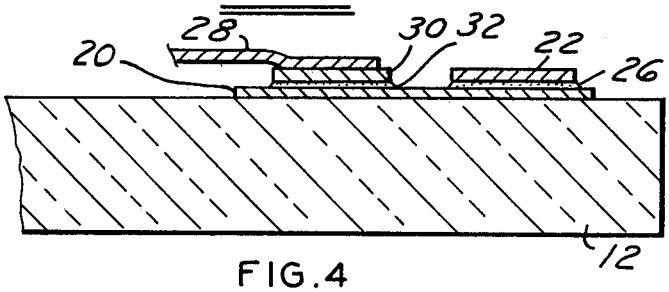
FIG. 3 is an enlarged drawing of a cross-section taken along line III—III of FIG. 1.

In accordance with the preferred embodiment disclosed herein, as is best shown in FIG. 3, the electrical lead 22 is also bonded by means of solder bond 26 to the power termination area 20. This condition would exist on both the right hand side of the glass sheet 12 and the left hand side of the glass sheet. A power terminal 28 is connected by means of a copper tab 30 and a solder bond 32 to the power termination area 20. In this manner, electrical energy may be supplied through the power terminal 28 from the electrical generation system of the automobile to the electrical lead 22, which is in turn electrically interconnected to the plurality of thin lines 14—14 by means of the interconnection areas, the right hand end portions 16—16 being numbered in FIG. 1. Thus, when the backlite becomes clouded by fog or ice, the vehicle operator turns on the appropriate switch, permitting electrical energy to flow through the plurality of thin lines 14—14. Because these lines do have an electrical resistance, the passage of electrical energy therethrough generates the required heat to effect a defogging or deicing of the backlite.

If one desires, the electrical lead 22 may be coupled directly to the power terminal 28 and the power termination area on both sides of the thin lines 14—14 may be eliminated.

Figure 4:
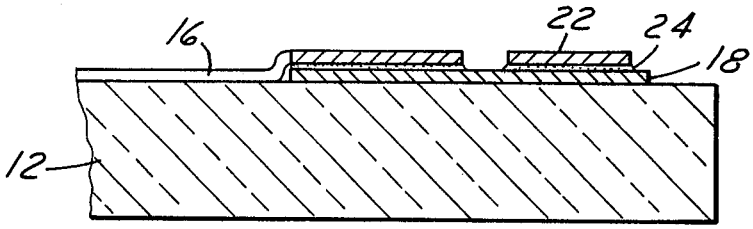
FIG. 4 is an enlarged cross-section view similar to FIG. 2 showing an alternate embodiment of the structure of this invention.

As described, the role of silk screen printing the nonprecious metal and the silver ceramic material may be interchanged. If this is carried out, the interconnection areas will, as demonstrated by a right hand end portion thereof 16 in FIG. 4, overlie a portion of the terminal area of silver ceramic material 18 as the silver ceramic material will be the first applied to the surface of the glass sheet in the silk screening operations.

As an additional matter, I prefer that each of the terminal areas 18—18 of silver ceramic material associated with each of the interconnection areas such as the right hand end portion 16—16 be in two portions. A first portion of the terminal area is in contact with an associated interconnection area and a second portion of the terminal area is bonded to the surface of the glass sheet 12 and not in contact with the associated interconnection area. I then desire that the electrical lead 22 be bonded to the second portion of each of the terminal areas. I prefer this construction because a very reliable solder joint can be made when the silver ceramic is directly printed on the base glass. However, if one desires, the termination of the electrical lead to the terminal area may be made at a location at which the terminal area overlies the interconnection area.

While, in the preferred embodiment, there has been illustrated a soldering operation as a method for attaching the various leads, it is understood that other bonding operations such as electrically conductive adhesives may be used in order to bond the leads to the various terminal areas.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

I claim:

1. An electric heater plate comprising:

a base material of electrically nonconductive material having at least a first surface to which metallic materials may be bonded;

a plurality of thin lines of a nonprecious metal which acts as a resistor when electrical energy flows therethrough, said plurality of thin lines being bonded to said first surface of said base material and extending from a first location on said first surface to a second location on said first surface;

at least two interconnection areas of a nonprecious metal which acts as a resistor when electrical energy flows therethrough, said interconnection areas being bonded to said first surface of said base material, one of said interconnection areas physically and electrically interconnecting said plurality of thin lines at said first location on said first surface and a second of said interconnection areas physically and electrically interconnecting said plurality of thin lines at said second location on said first surface;

a terminal area of silver ceramic material associated with each of said interconnection areas, each of said terminal areas having both a first portion thereof overlying and physically and electrically bonded to an associated interconnection area and a second portion thereof overlying and bonded to said first surface of said base material and not in contact with said associated interconnection area; and an electrical lead bonded to each of said terminal areas for making electrical connection to said plurality of thin lines.

2. An electric heater plate comprising:

a base material of electrically nonconductive material having at least a first surface to which metallic materials may be bonded;

a plurality of thin lines of a nonprecious metal which acts as a resistor when electrical energy flows therethrough, said plurality of thin lines being bonded to said first surface of said base material and extending from a first location on said first surface to a second location on said first surface;

at least two interconnection areas of a nonprecious metal which acts as a resistor when electrical energy flows therethrough, said interconnection areas being bonded to said first surface of said base material, one of said interconnection areas physically and electrically interconnecting said plurality of thin lines at said first location on said first surface and a second of said interconnection areas physically and electrically interconnecting said plurality of thin lines at said second location on said first surface;

a terminal area of silver ceramic material associated with each of said interconnection areas, each of said terminal areas bonded to said first surface of said base material and having both a first portion thereof underlying and physically and electrically bonded to an associated interconnection area and a second portion thereof not in contact with said associated interconnection area; and an electrical lead bonded to each of said terminal areas for making electrical connection to said plurality of thin lines.

3. The electric heater plate of claim 1 or 2, wherein said nonprecious metal is selected from the group consisting of copper, nickel and aluminum.

4. The electric heater plate of claim 1 or 2, wherein said electrical lead is bonded to said terminal areas by a solder bonding operation.

5. The electric heater plate of claim 1 or 2, wherein said base material is a sheet of glass.

6. The electric heater plate of claim 1 or 2, wherein said base material also has bonded to said first surface thereof at least two power terminations areas, formed of electrically conductive material wherein one of said electrical leads is bonded to each of said power termination areas, and wherein a power terminal is bonded to each of said power termination areas.

* * * * *